US006016745A

United States Patent [19]

Bartel et al.

[11] Patent Number: 6,016,745

[45] Date of Patent: Jan. 25, 2000

[54] TWO PIECE DIE CHARACTER WHEEL ASSEMBLY FOR EMBOSSING MACHINES

[75] Inventors: Keith A. Bartel, O'Fallon; Angela Ranae Greene, St. Charles, both of Mo.

[73] Assignee: Automark Marking Machines, Inc., St. Louis, Mo.

[21] Appl. No.: 09/179,051

[22] Filed: Oct. 26, 1998

[51] Int. Cl.[7] ..... B31F 1/07

[52] U.S. Cl. ..... 101/18

[58] Field of Search ..... 400/134, 134.1, 400/134.2, 142; 101/3.1, 18

[56] References Cited

U.S. PATENT DOCUMENTS

| | | | |
|---|---|---|---|
| 1,391,890 | 9/1921 | Green | 101/3.1 |
| 2,937,590 | 5/1960 | Priesmeyer | 101/31.1 |
| 3,129,800 | 4/1964 | Bogeaus | 101/20 |
| 3,155,215 | 11/1964 | Avery | 101/18 |
| 4,688,785 | 8/1987 | Nubson et al. | 400/134 |
| 4,969,760 | 11/1990 | LaManna et al. | 400/134 |

*Primary Examiner*—Ren Yan
*Assistant Examiner*—Amanda B. Sandusky
*Attorney, Agent, or Firm*—Greenfelder, Hemker & Gale, P.C.

[57] ABSTRACT

An improvement is provided for an embossing machine of the type having a rotating dual die character wheel assembly. The die character wheels are mounted independently from their outer surfaces within the embossing machine so that a completely unobstructed region exists between the character wheels. This allows a workpiece to be marked to pass unimpeded through the region so that the entire workpiece is capable of being marked. Pinion gears are provided at the outer periphery of the character wheels which engage ring gears mounted on the character wheels whereby the character wheels are rotated simultaneously.

17 Claims, 12 Drawing Sheets

-Prior Art-

-Prior Art-

TWO PIECE DIE CHARACTER WHEEL ASSEMBLY FOR EMBOSSING MACHINES

BACKGROUND OF THE INVENTION

This invention relates to automatic embossing machines, and more specifically, to the die character wheel assembly of such machines.

There exist many types of machines for marking on substrates such as metal or plastic tags and the like. The resultant marks may comprise an imprint, which consists of a stamped impression, or an embossment, which consists of an impression on one side of the marked tag and a corresponding raised area on the other side of the tag. Machines that produce imprints typically have a punch and die element that addresses only one side of the tag, while the other side of the tag bears against a flat surface. Machines that produce embossments, however, require male and female punch and die elements that simultaneously bear against opposite sides of the tag. These types of machines, and the marks they produce, are well known in the art.

For various reasons, an embossed mark is generally desired on metal or plastic tags. The raised surface of the embossed mark facilitates reading of the mark when viewed from an angle, and also retards the obliteration of the mark from repeated paintings and coatings. With an imprinted mark, on the other hand, paint and dirt can rapidly fill in the impression to the point where the mark is rendered illegible. Additionally, a mark made within and below the surface is difficult to read when viewed from an angle.

The drawback to creating an embossed mark is that both a male punch and a female die are required to effect the raised mark on the surface of a tag. The punch and die must oppose each other on opposite sides of the tag. This type of arrangement is generally provided by a rotatable die character wheel assembly such as that shown in U.S. Pat. No. 3,263,789. This assembly comprises dual wheels with their inside faces opposed to each other, with one wheel bearing the male punch dies around its periphery and the other wheel bearing the female dies around its periphery. However, to synchronously rotate the die character wheels to allow for proper alignment of the respective punch and die for a particular character, the wheels are joined by a central integral hub. The hub also allows for the wheels to be spaced from each other to create a planar gap for passage through of the tag to be marked.

The punch and die activity actually takes place at a single location, because the die character wheels rotate to put the desired die character element in alignment with a plunger which punches down on the die character element to make the impression on the tag. The plunger itself is fixed at one location in the machine, so the die character elements must be individually moved into position under the plunger. Accordingly, the tag also must be moved so that the place on the tag which is to receive the embossment must be moved into position under the plunger.

Because of this central hub between the die character wheels, however, an obstruction is created which impedes the passage of the tag within the planar work area of the die character wheel assembly. Accordingly, the effective marking area on any tag is limited with respect to how far within the die character wheel assembly housing the tag can travel before it is obstructed by the central connective hub. This is a disadvantage with respect to how large a tag can be marked by embossing using a die character wheel assembly. Depending upon the size diameter of the die character wheel, the point furthest below the top edge of a tag to be marked is no greater than a few inches.

This limitation is unacceptable for many purposes which require an embossed tag larger than a few inches. For instance, tags to be used as identification plates for heavy equipment necessarily need to be large. Also, it is desirable that the discrete marking die characters be available in larger sizes. To accommodate larger size die characters, the corresponding effective work area should be increased.

Accordingly, there is a need for an embossing die character wheel assembly that can provide an unimpeded marking work area so that larger tags can be accommodated.

SUMMARY OF THE INVENTION

According to the present invention there is provided a two piece die wheel assembly for embossing machines that allows unimpeded access of a tag within the area between the die character wheels. The wheels of the assembly are adapted to be independently mounted from their outer sides within the embossing machine housing, thereby omitting the internal central hub which was necessary to jointly connect the wheels of the prior art. The wheels are equipped with gearing around their peripheries and are simultaneously driven by external gears.

Because the central hub is not present in the inventive wheel assembly, a tag presented for marking between the wheels can pass entirely through this planar area without blockage. Accordingly, this arrangement makes the entire tag, including the bottom edge area, to be capable of being marked.

A carrier assembly for holding the tag and moving it back and forth between the die character wheels is also provided. It comprises a clamp, which receives the tag, and a rail and roller assembly configured in an X and Y axis orientation with respect to the planar area between the die character wheels.

The above features are objects of this invention. Further objects will appear in the detailed description which follows and will be otherwise apparent to those skilled in the art.

For purpose of illustration of this invention a preferred embodiment is shown and described hereinbelow in the accompanying drawing. It is to be understood that this is for the purpose of example only and that the invention is not limited thereto.

IN THE DRAWINGS

DESCRIPTION OF THE INVENTION

Figure 1:
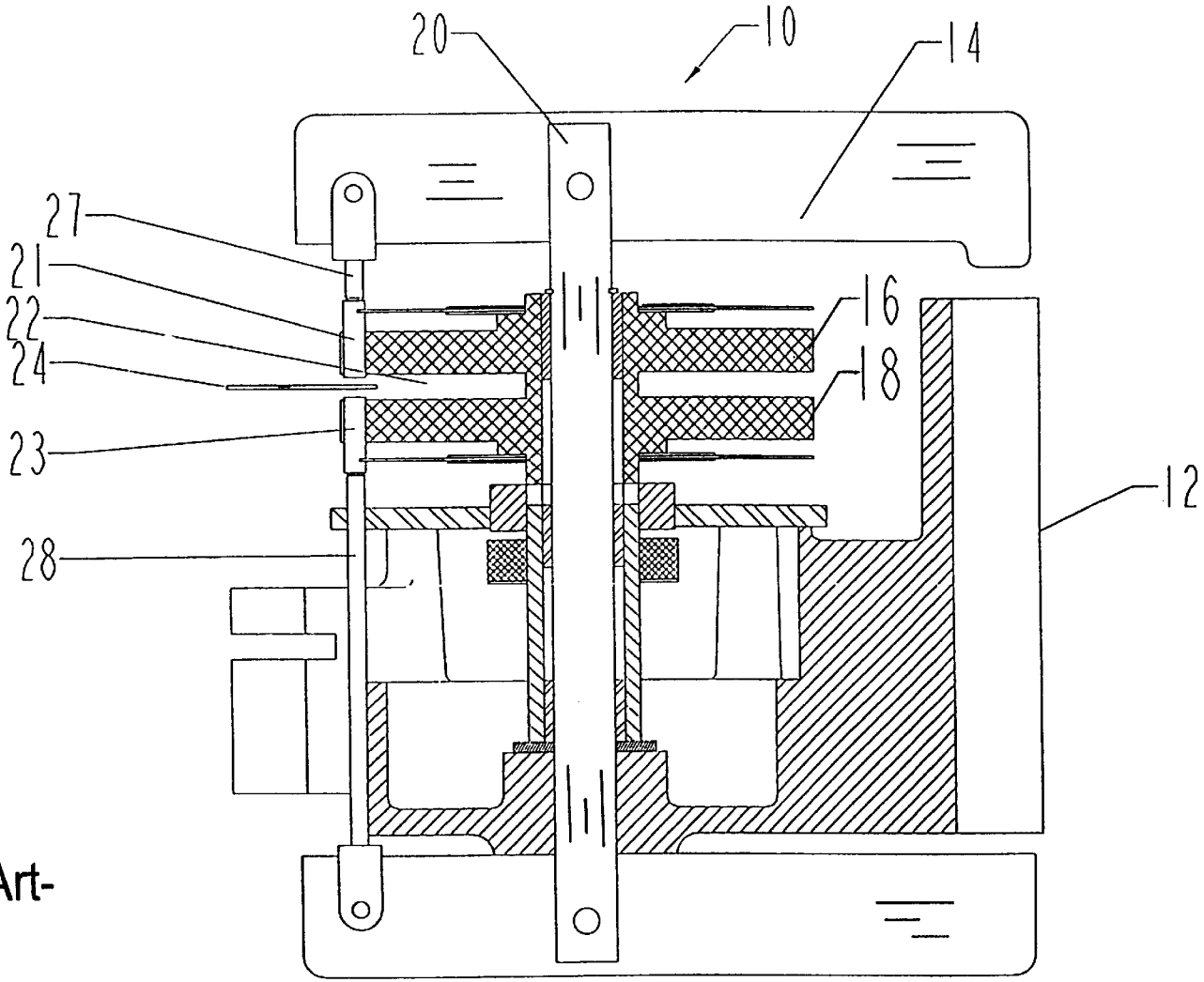
FIG. 1 is a view in side elevation from the side of a prior art die wheel assembly.

Embossing machines of the prior art are well known to those skilled in the art, so a general limited description of the common elements of a die character wheel assembly will be given. An embossing machine 10 comprises a housing 12 in which a prior art die character wheel assembly 14 is mounted as shown in FIG. 1. This type of die wheel assembly is comprised of two opposing wheels 16 and 18 connected by a central hub 20. Accordingly, the wheels 16 and 18 are constructed as a fixed unit and rotate together. They are spaced from one another to leave a gap 22 so that a workpiece or tag 24 may be inserted therebetween. Each of the wheels has dies comprising character elements (not shown) positioned around its periphery. The die character elements are constructed so as to operate and move through guide openings 26 that are formed by vertical openings in the periphery of each wheel. The top wheel 16 may be provided with die character head elements which are male in character and operate as a punch, while the bottom wheel 18 is provided with character head elements having a recessed portion to operate as a die. This arrangement can be reversed for debossing operations, by having the male elements on the bottom wheel and the female elements on the top wheel. The die character elements are held in position by various means well known to those having skill in the art, such as a spider spring which comprises a spring steel element having radial arms which engage and retain the individual die character elements and allow them to spring back into original position after any displacing movement.

The die character elements are adapted to be actuated by an operating arm contact member, or plunger, 27 so that for the upper wheel 16 the die character elements 21 are moved downwardly against the tag 24. In like fashion, the die character elements 23 in the bottom wheel 18 are adapted to be struck upwardly by a plunger 28 so that the two die character elements are moved toward one another to form an embossed impression of the die character on the tag when it is positioned between them. The respective plungers strike at only one point on the machine, so the wheels must be rotated to move the desired die character element in position with the plungers. The integral wheel assembly unit 14 is typically driven by a motor (not shown) which engages the central connecting hub 20 of the two wheels, thus driving the wheels simultaneously. Control of the motor is effected by conventional means known to those skilled in the art, such as by computer or other electromechanical means.

Figure 2:
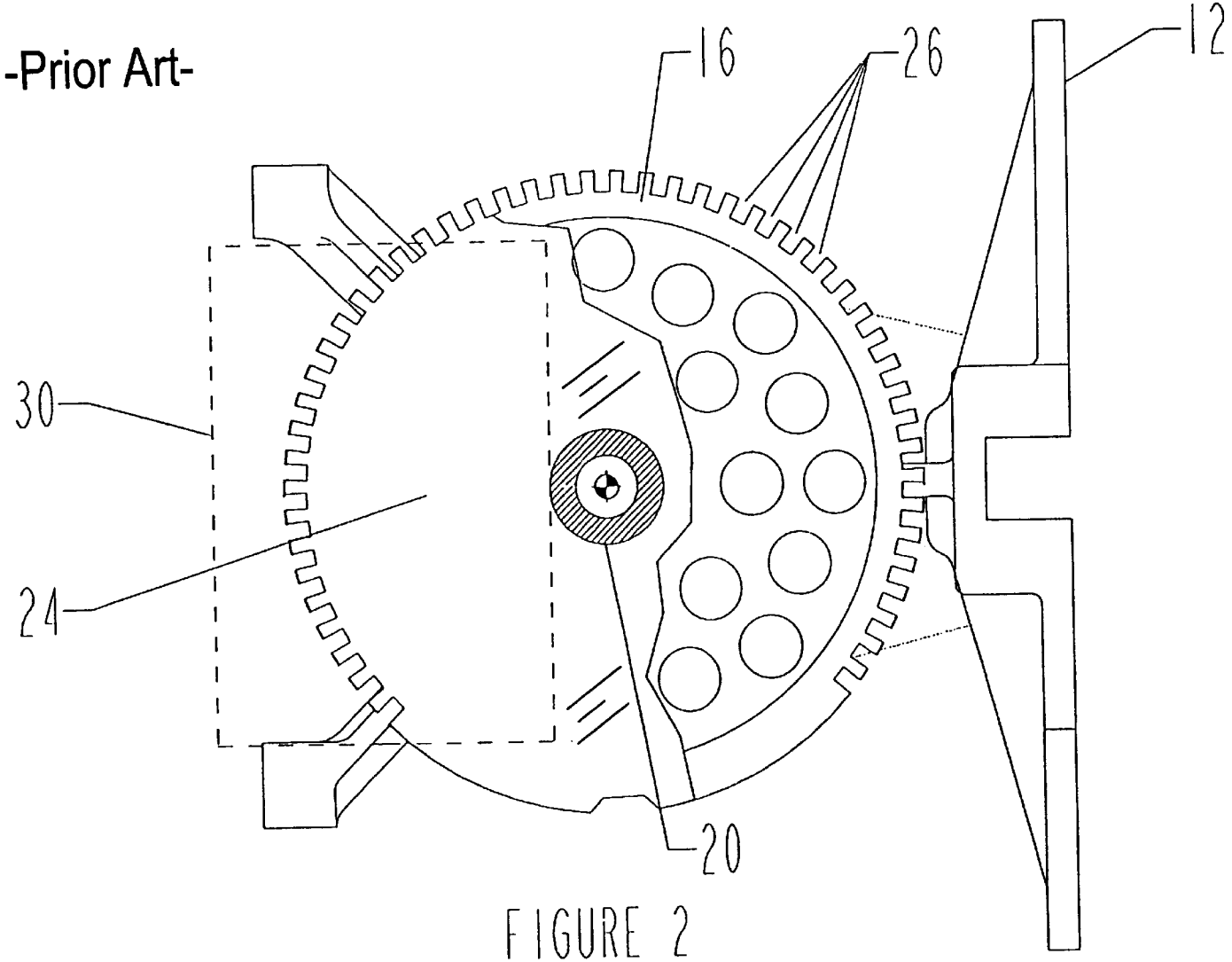
FIG. 2 is a top plan view of a prior art die wheel assembly with the top wheel shown partially broken away.

FIGS. 1 and 2 show a workpiece or tag 24 placed within wheel assembly 14 for marking. Conveyors and carriages, as are well known in the art, are provided on embossing machines for moving the tag back and forth between the die character wheels to position the area of the tag to be marked on between the plungers, and the range of such movement affects the effective work area for marking. The effective work area on the tag is limited by the central hub 20 in that the tag can not pass beyond it as shown in FIGS. 1 and 2. Therefore, the bottom edge area 30 of the tag 24 may not come within the effective work area for marking.

Figure 3:
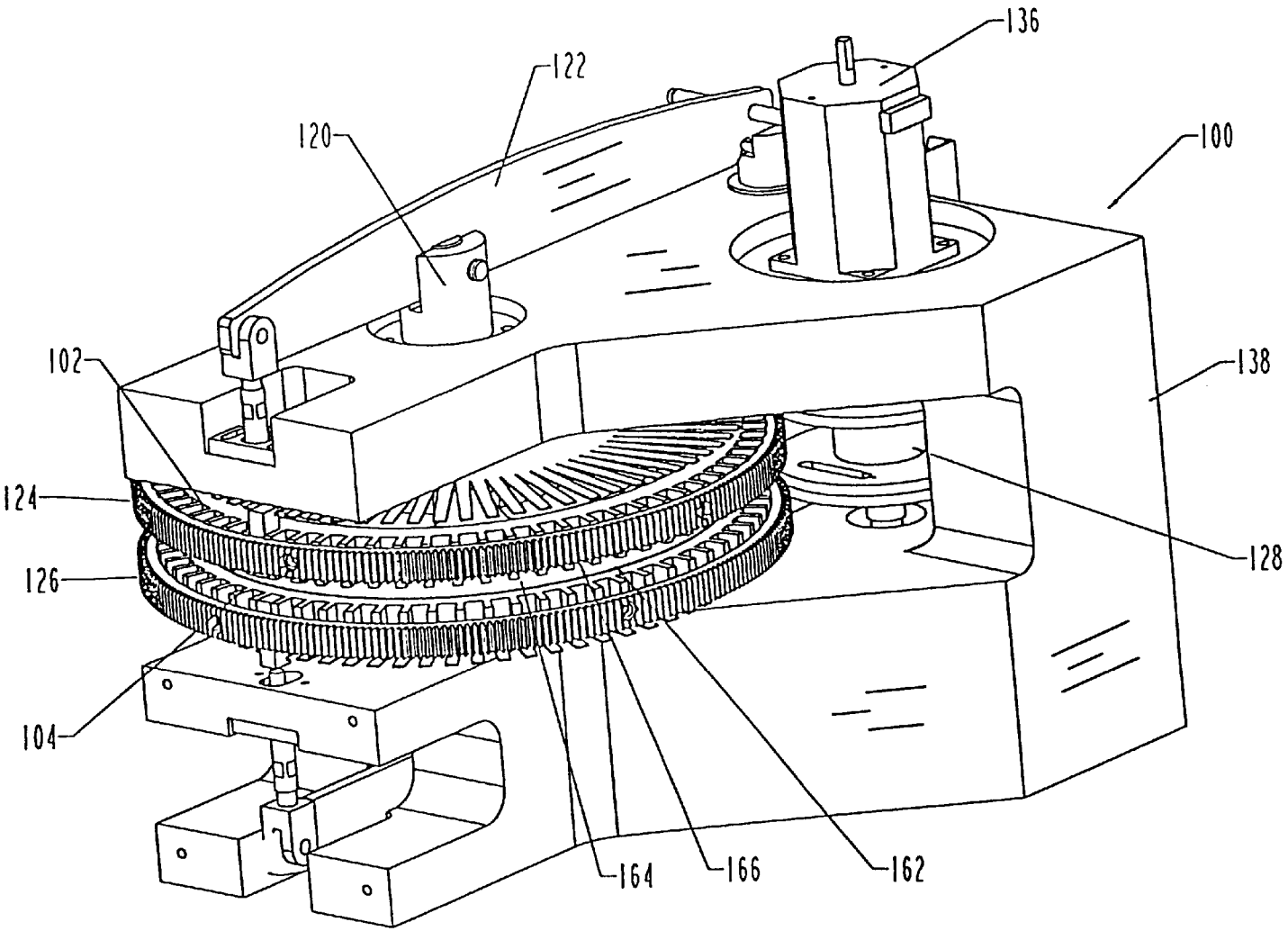
FIG. 3 is a perspective view of an embossing machine featuring the die character wheel assembly of the present invention.

The embossing machine incorporating the wheel assembly of the instant invention is generally indicated by the reference numeral 100 and is shown in FIG. 3. The broad concept of embossing using die character elements arrayed within a rotatable die character wheel is the same as in prior art machines. The improvement comprises the use of die character wheels 102 and 104 which are independently mounted within the embossing machine. The wheels are mounted without a central connecting hub so that an unobstructed planar gap 105 exists over the entire area between the wheels.

Figure 4:
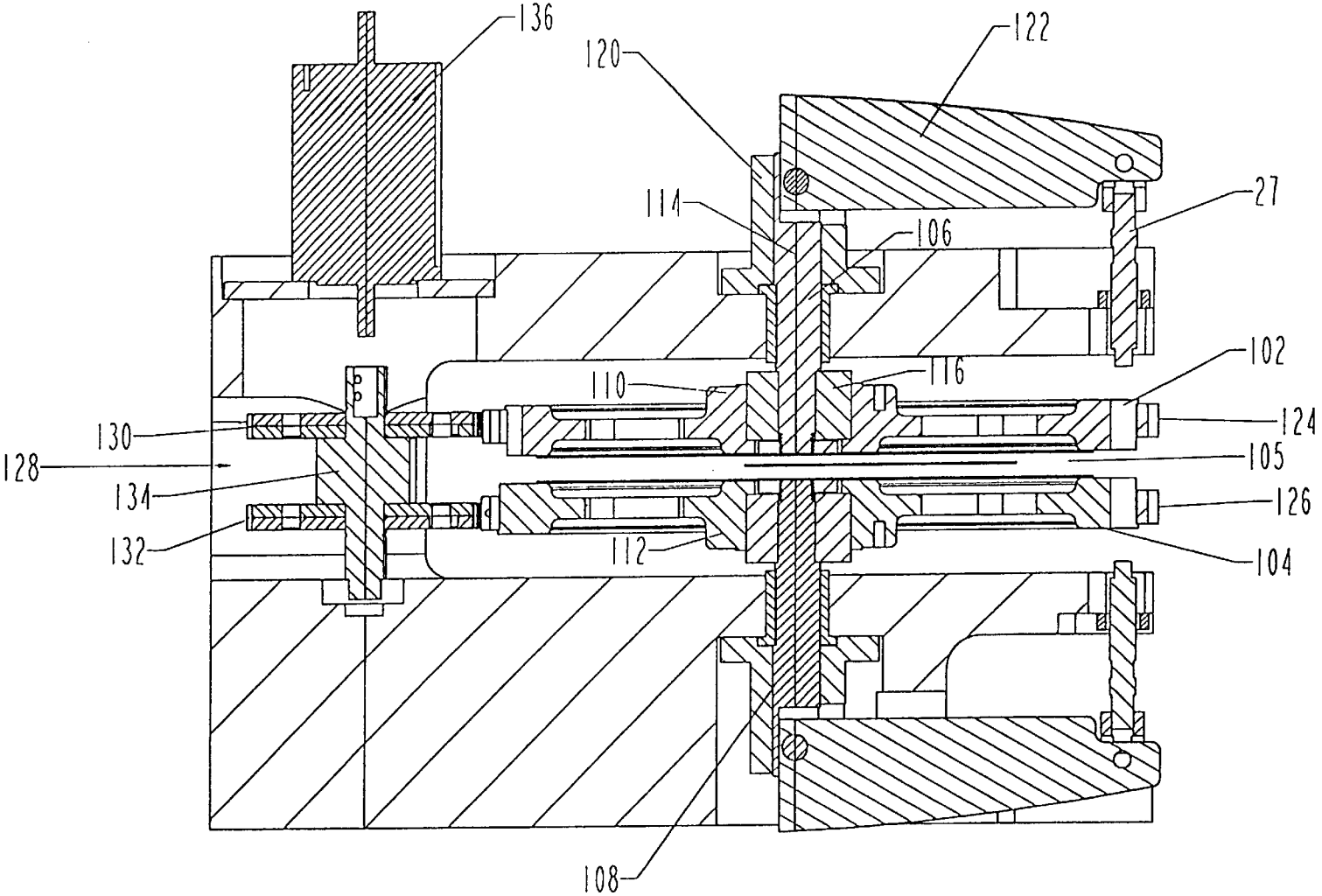
FIG. 4 is a view in side elevation from the side of the embossing machine featuring the die character wheel assembly of the present invention.

As shown in FIG. 4, shaft members 106 and 108 attach to outer surfaces 110 and 112, respectively, of die character wheels 102 and 104. Shaft members 106 and 108 may be disposed within the embossing machine in various manners as will be apparent to those skilled in the art. For instance, the shaft members may be fixed in place and receive the die character wheels so that the wheels freely rotate about the axis of the shaft members. Alternately, the wheels may be fixed onto the shaft members, with the shaft members being rotatably received within the embossing machine so that the shafts themselves rotate.

Figure 9:
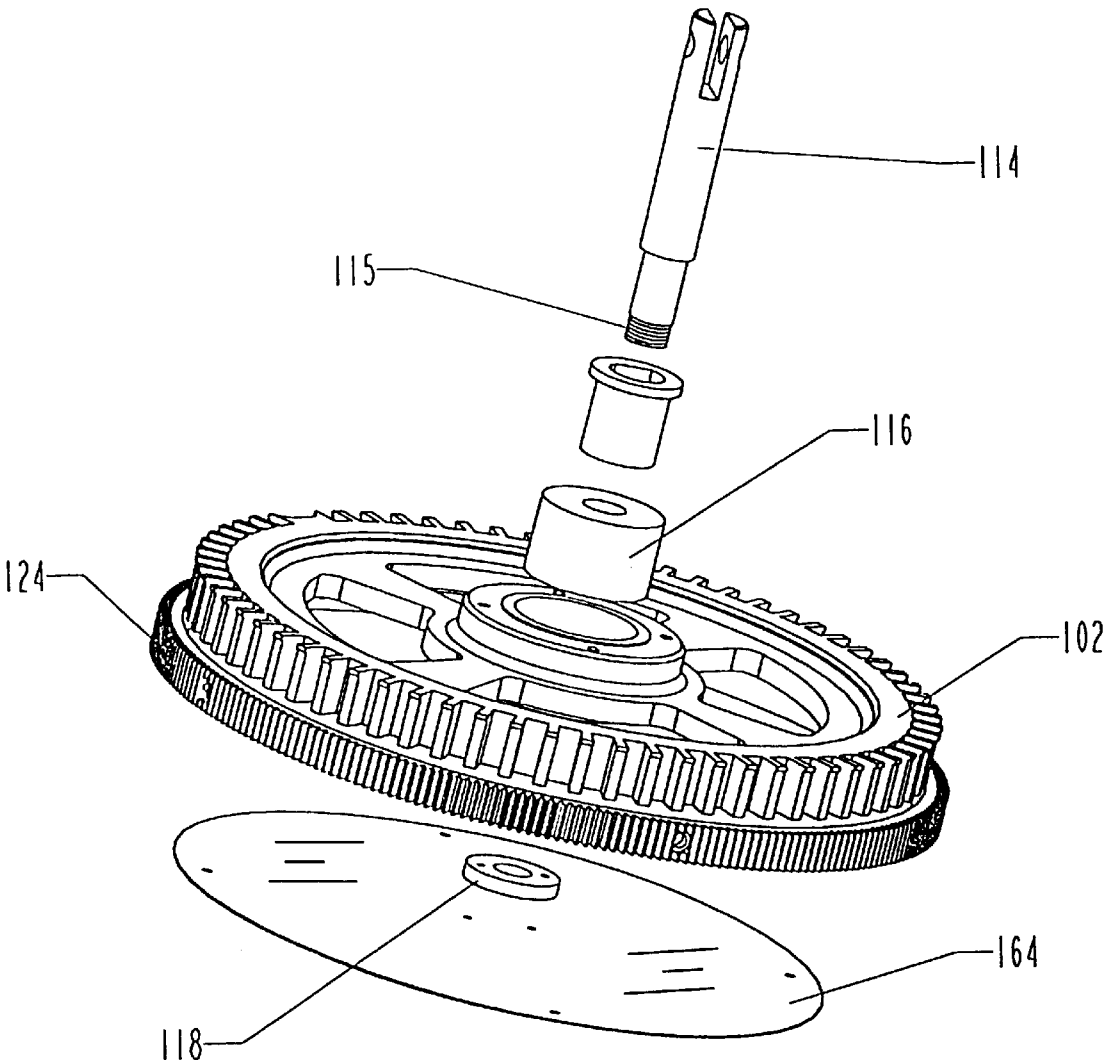
FIG. 9 is an exploded view of one embodiment of an attachment of the die character wheel.

One embodiment of the manner of attachment of the die character wheels within the embossing machine is shown in FIGS. 4 and 9. Reference is made to die character wheel 102 with the understanding that common structure applies in like manner to wheel 104. Character wheel 102 has a bearing 116 centrally disposed on an outer surface thereon. Shaft member 106 is comprised of shaft stem 114 which is rotatably received within bearing 116. Shaft stem 114 is threaded at its lower end 115 which receives nut 118 to secure the character wheel to the shaft. An upper end of shaft stem 114 is received within the rocker arm support column 120, which supports, as a fulcrum, the rocker arm 122 for plunger 27. Character wheel 104 is equipped in like manner, but reversed with respect to being received on the lower rocker arm assembly. This arrangement allows for rotation of the wheels about their central axis.

Through this structural arrangement of independently mounted die character wheels, not only is an unobstructed gap between the wheels created, but there is also the advantage of removing the die character wheels independently of each other. For instance, if one wheel becomes defective, only that wheel need be replaced rather than the entire dual wheel structure. Further, easier access to the inner surfaces of the wheels is afforded, unlike the fixed gap between unitary wheel assemblies.

Figure 6:
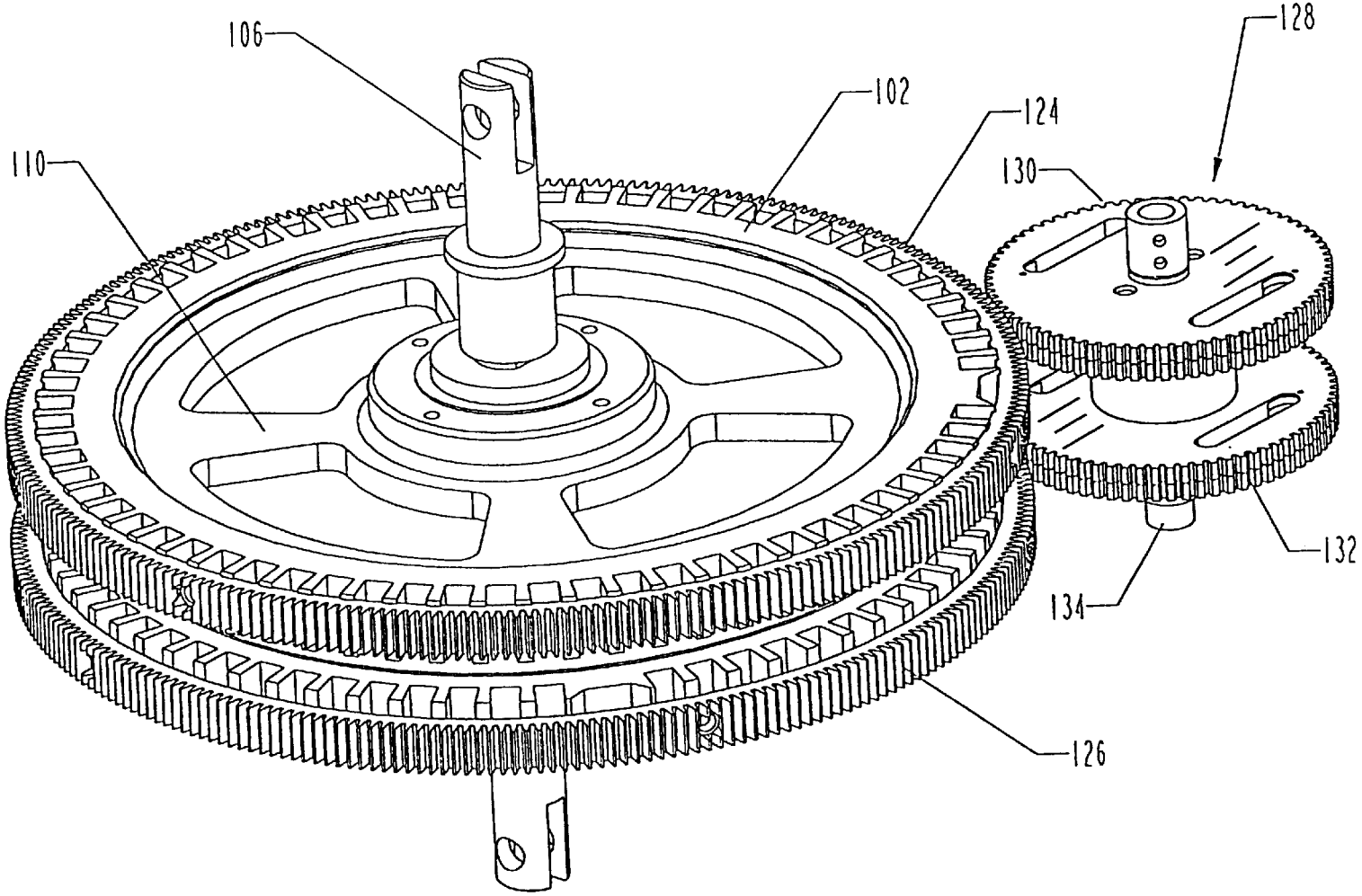
FIG. 6 is a perspective view of the die character wheel assembly, ring gear assembly and pinion gear assembly.
Figure 7:
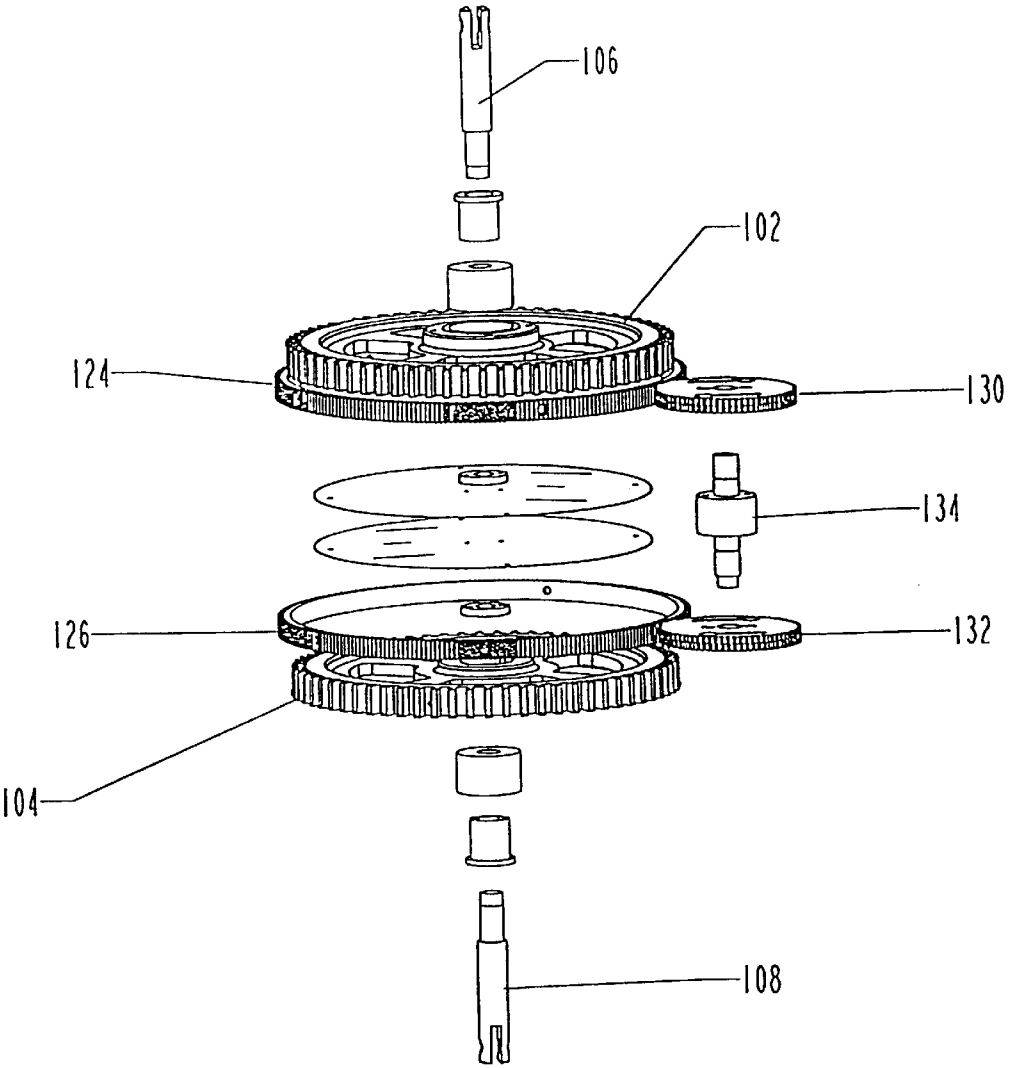
FIG. 7 is a partially exploded view of the die character wheel assembly, ring gear assembly and pinion gear assembly.
Figure 8:
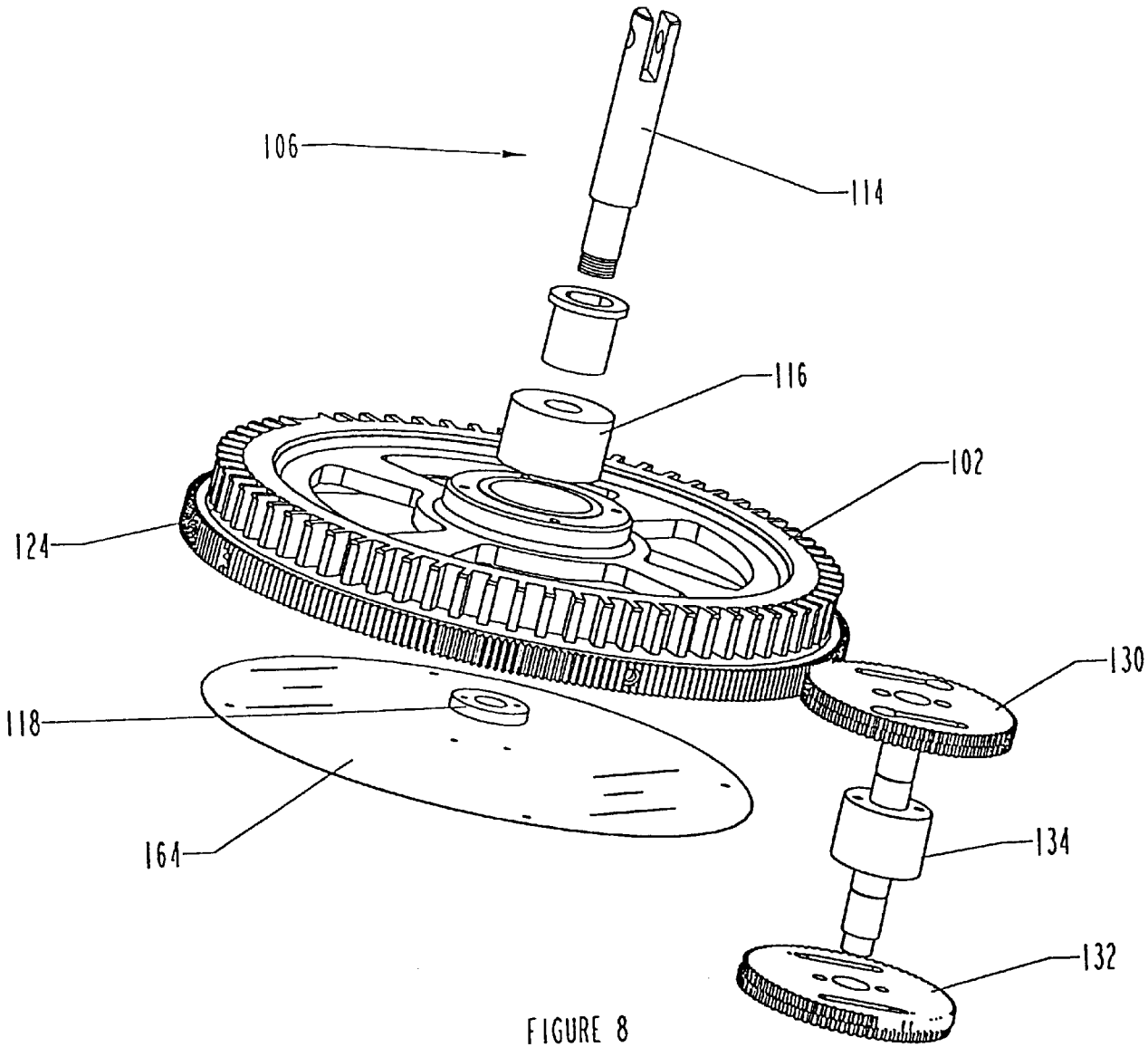
FIG. 8 is an exploded view of the die character wheel assembly, ring gear assembly and pinion gear assembly.

The die character wheels of the present invention are rotated and driven by gears. Circumferential ring gear members 124 and 126 are placed around die character wheels 102 and 104, respectively, as shown in FIGS. 6–8. They may be secured in place by any appropriate means, such as by screwing on with allen screws or by detent and groove means. A pinion gear assembly 128 is disposed in proximity to the peripheral edge of the die character wheels to engage the ring gear members. Gear wheels 130 and 132, which are connected by pinion gear shaft member 134, engage ring gear members 124 and 126 respectively so that the die character wheels are simultaneously rotated when driven by the pinion gear assembly.

Figure 5:
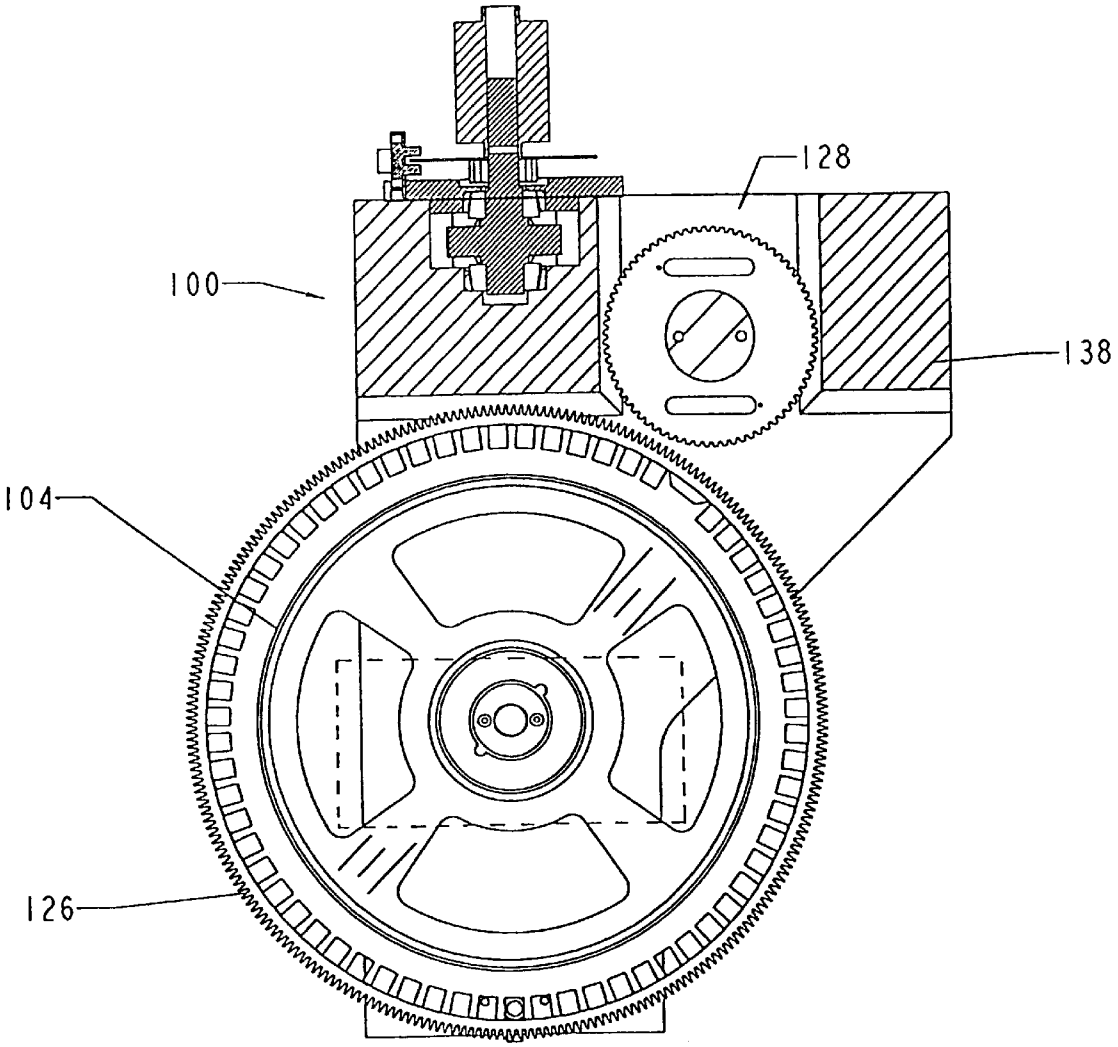
FIG. 5 is a top plan view showing the lower wheel of the die character wheel assembly within the embossing machine housing with the top die character wheel removed and the embossing machine housing partially broken away.

The pinion gear assembly 128 is itself driven by a motor 136 or other appropriate driving means. Motor 136 may be directly connected with gear shaft member 134 of the pinion gear assembly, or may drive the gear assembly through pulleys. FIG. 3 shows the arrangement of the pinion gear assembly 128 and motor 136 as arranged in the embossing machine. Because the driving means for rotating the die character wheels are disposed at the periphery of the wheels, the housing 138 of embossing machine 100 may be modified to accommodate the structure as shown in FIGS. 3 and 5.

Figure 10:
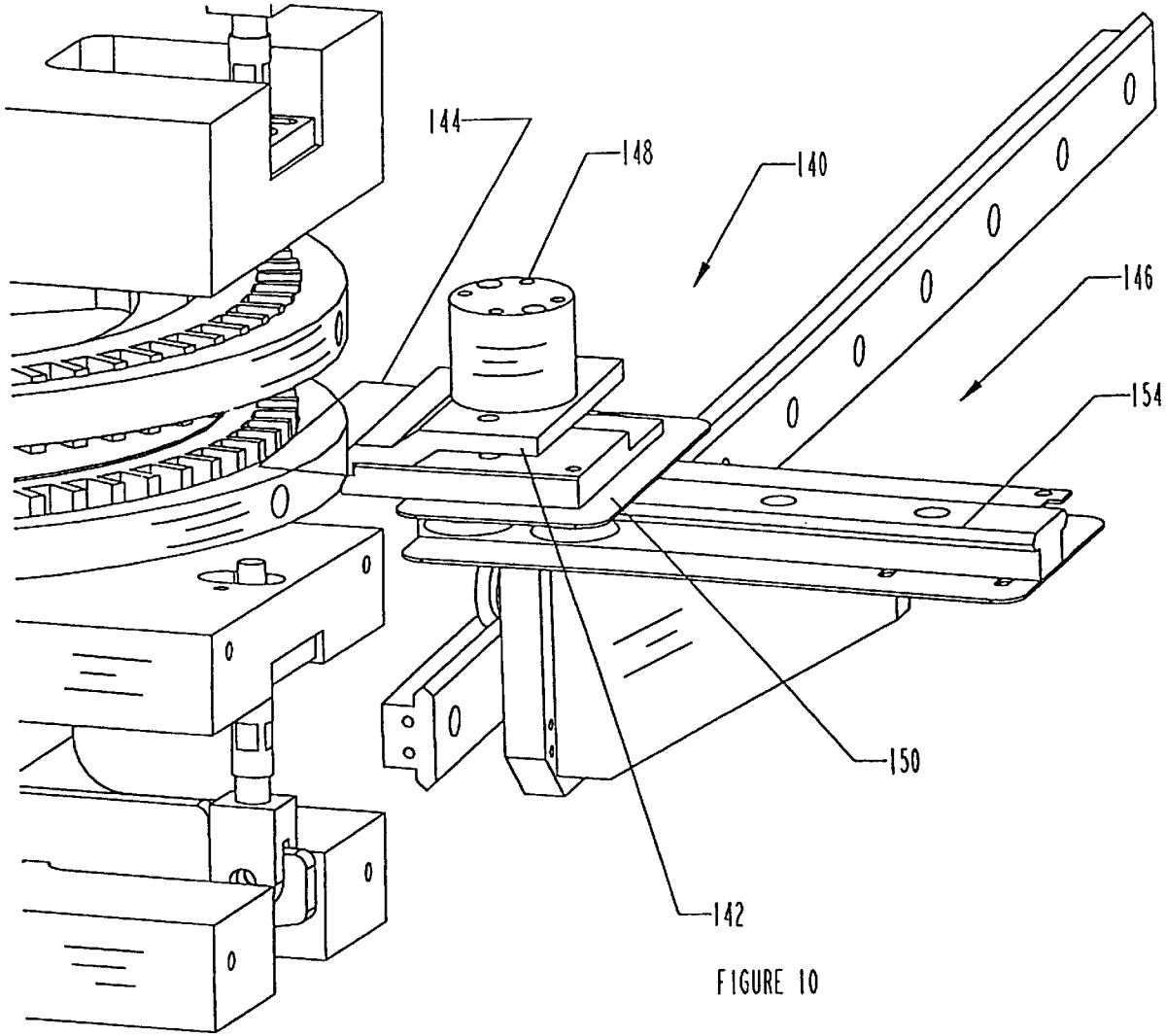
FIG. 10 is a view in side elevation from the side showing the carrier assembly.
Figure 11:
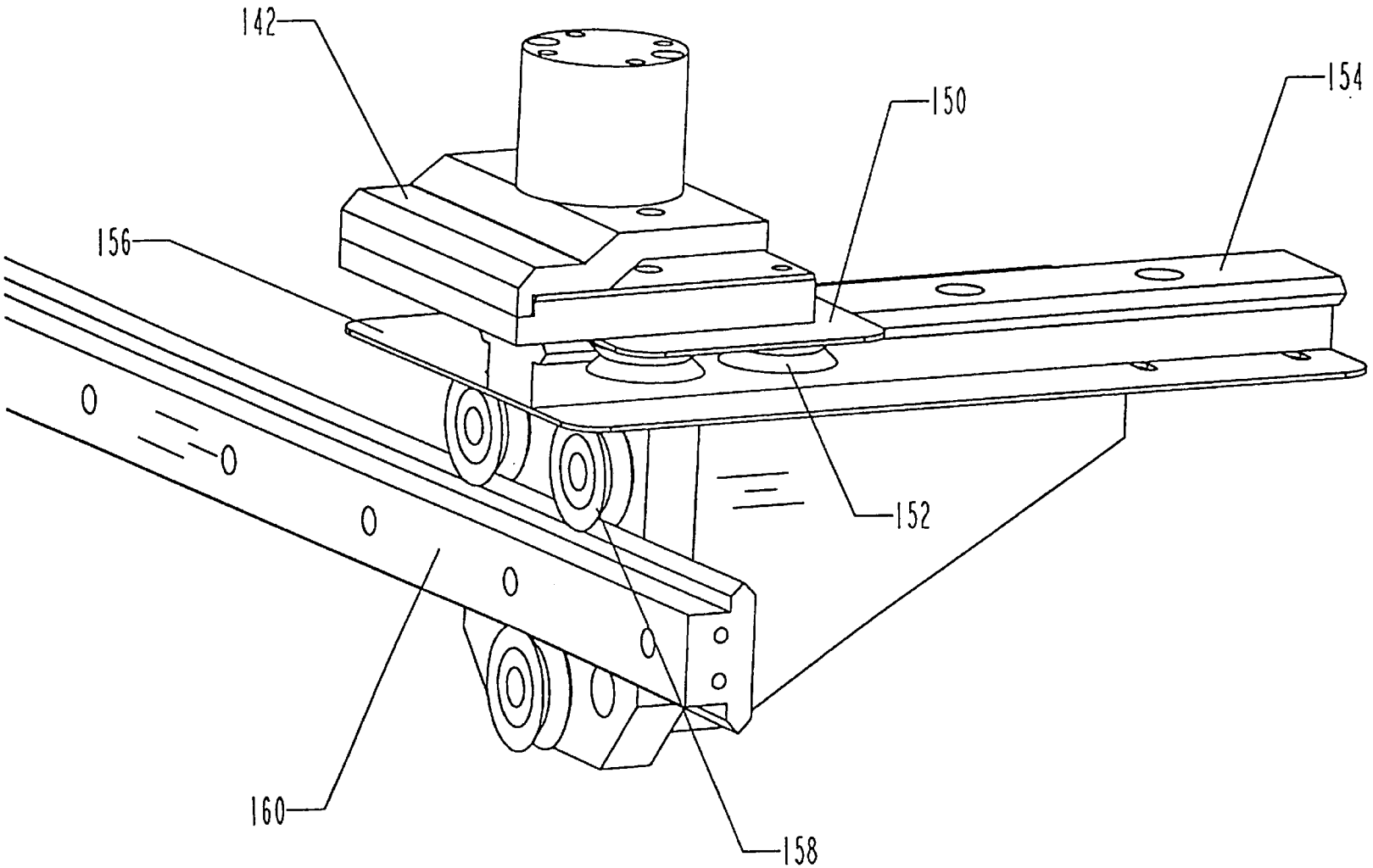
FIG. 11 is a perspective view of the carrier assembly.
Figure 12:
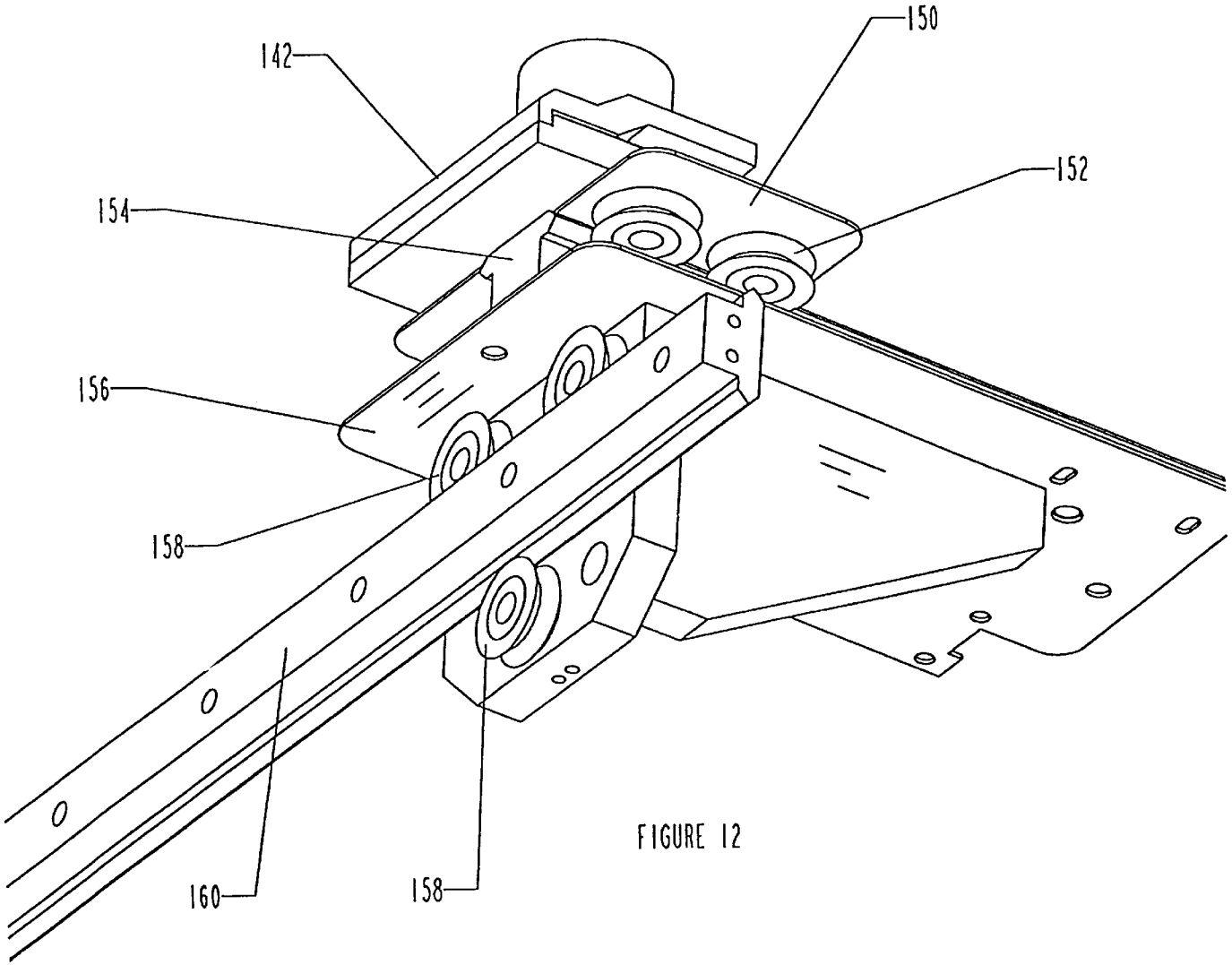
FIG. 12 is a perspective view of the underside of the carrier assembly.

With the increased area over which the tag may pass during the marking operation, the need for a more efficient carrier system is created. FIGS. 10–12 show carrier assembly 140, which is comprised of a clamping member 142 for holding the tag 144, and a rail and roller assembly 146 positioned in an X and Y axis orientation with respect to the planar gap 105. The opening and closing of clamping member 142 is controlled by air cylinder 148. Clamping member 142 is positioned on sliding member 150 which has roller wheels 152 as shown in FIG. 11. Rail 154 is aligned in the Y axis direction and receives roller wheels 152 in sliding engagement to allow clamp 142 to travel along the length of rail 154 to effect movement of the tag in the Y axis direction within planar gap 105. The edge of rail 154 is bevelled outwardly, and roller wheels 152 are bevelled inwardly, so that a close sliding engagement can be achieved without risk of derailment or drift. Further, providing the rail with an outward bevel prevents the accumulation of debris in the rail channel. A buildup of debris can cause a binding of the roller members and lead to failure of the carrier assembly. Rail 154 is provided with a travel plate 156 which has roller wheels 158 on an underneath side thereof. Rail 160 is aligned in the X axis direction and receives roller wheels 158 in sliding engagement to allow rail 154 to travel along the length of rail 160 to effect movement of the tag in the X axis direction within planar gap 105. Rail 160 and roller wheels 158 have a similar bevelled shape as that for rail 154 and roller wheels 152, respectively.

To keep the tag in level alignment as it passes through planar gap 105, a guide 162 is provided between the die character wheels as shown in FIG. 3. Guide 162 is comprised of guide sheet members 164 and 166, each connected to one of the die character wheels. With the independently mounted die character wheel assembly of the present invention, a tag can be marked by an embossing machine at essentially any location on the tag because there is no obstruction to prevent passage of the entire tag between the die character wheels. Accordingly, larger tags than have herebefore been used can be marked.

Various changes and modifications may be made within this invention as will be apparent to those skilled in the art. Such changes and modifications are within the scope and teaching of this invention as defined in the claims appended hereto.

What is claimed is:

1. In an embossing machine having a rotating die character wheel assembly comprised of opposing first and second die character wheels for receiving individual die character elements, the improvement comprising mounting said opposing die character wheels independently from each other within said embossing machine, each of said die character wheels having means for being mounted at an outer surface with respect to said other die character wheel, such that said opposing die character wheels have an unobstructed region between them to allow for passage of a workpiece along any area between said wheels, each of said die character wheels being supported from its said outer surface by respective central shaft members, said central shaft members being supported within said embossing machine, said central shaft members being fixed and stationary, and said die character wheels being rotatable about said central shaft members.

2. The embossing machine of claim 1 in which said die character wheels are removable from said central shaft members, whereby a first of said die character wheels is independently replaceable from said embossing machine without removal of a second die character wheel.

3. The embossing machine of claim 1 in which means are provided for rotating said die character wheels simultaneously.

4. The embossing machine of claim 3 in which each of said die character wheels is rotated by gear means.

5. The embossing machine of claim 4 in which each of said die character wheels is provided with a ring gear member which is adapted to engage a pinion gear member, said pinion gear member providing means to rotate said die character wheels.

6. The embossing machine of claim 5 in which said ring gear member comprises a circumferential member adapted to engage a peripheral edge of said respective die character wheel.

7. The embossing machine of claim 5 in which said pinion gear member is disposed within said embossing machine in near proximity to a peripheral edge of each of said die character wheels.

8. The embossing machine of claim 5 in which said pinion gear member comprises first and second gear wheels which respectively engage said ring gear members on said first and second die character wheels, whereby said pinion gear member simultaneously rotates said die character wheels.

9. The embossing machine of claim 8 in which said pinion gear member is directly driven by a motor.

10. The embossing machine of claim 8 in which said pinion gear member is indirectly driven by a motor.

11. The embossing machine of claim 1 in which a workpiece is maneuvered within and along said unobstructed region by means of a carrier assembly, said carrier assembly comprising a clamping member for retaining said workpiece, and a rails and rollers assembly, said rails being configured in an X and Y axis orientation with respect to the plane of said unobstructed region, said rollers comprising a first roller set being adapted to engage an outer edge of a first rail disposed along the Y axis in a sliding relationship and a second roller set being adapted to engage an outer edge of a second rail disposed along the X axis in a sliding relationship, said clamping member being connected to said first roller set to allow movement of said clamping member along a direction in the Y axis, said first rail being connected to said second roller set to allow movement of said first rail along a direction in the X axis, whereby said clamping member is capable of moving along said X and Y axis orientation to enable said workpiece to be moved within and along said unobstructed region.

12. The embossing machine of claim 11 in which said outer edges of said first and second rails are bevelled outwardly, said first and second roller sets having roller wheel members having edges which are bevelled inwardly, whereby said roller wheel members engage said edges of said rails in sliding relationship.

13. In an embossing machine having a rotating die character wheel assembly comprised of opposing first and second die character wheels for receiving individual die character elements, the improvement comprising mounting said opposing die character wheels independently from each other within said embossing machine, each of said die character wheels having means for being mounted at an outer surface with respect to said other die character wheel, such that said opposing die character wheels have an unobstructed region between them to allow for passage of a workpiece along any area between said wheels, each of said die character wheels being supported from its said outer surface by respective central shaft members, said central shaft members being supported within said embossing machine, said die character wheels being fixed to said central shaft members, and said central shaft members being rotatable within said embossing machine, gear means rotating said die character wheels simultaneously.

14. The embossing machine of claim 13 in which said shaft members are removable from said embossing machine, whereby a first of said die character wheels is independently replaceable from said embossing machine without removal of a second die character wheel.

15. The embossing machine of claim 13 in which each of said die character wheels is provided with a ring gear member which is adapted to engage a pinion gear member, said pinion gear member providing means to rotate said die character wheels.

16. The embossing machine of claim 15 in which said pinion gear member is disposed within said embossing machine in near proximity to a peripheral edge of each of said die character wheels.

17. The embossing machine of claim 15 in which said pinion gear member comprises first and second gear wheels which respectively engage said ring gear members on said first and second die character wheels, whereby said pinion gear member simultaneously rotates said die character wheels.

* * * * *